US006560820B2

(12) United States Patent
Heisig et al.

(10) Patent No.: US 6,560,820 B2
(45) Date of Patent: May 13, 2003

(54) HINGE, AND METHOD FOR HEIGHT ADJUSTMENT OF A HINGE

(75) Inventors: Rolf Heisig, Reutlingen (DE); Roman Pyschik, Bonn (DE); Wladislaw Wasiliewski, Cologne (DE)

(73) Assignee: Prämeta GmbH & Co. KG, Köln (DE)

( * ) Notice: Subject to any disclaimer, the term of this patent is extended or adjusted under 35 U.S.C. 154(b) by 0 days.

(21) Appl. No.: 09/789,548

(22) Filed: Feb. 22, 2001

(65) Prior Publication Data

US 2001/0020317 A1 Sep. 13, 2001

(30) Foreign Application Priority Data

Mar. 10, 2000 (DE) ..... 100 11 449

(51) Int. Cl.[7] ..... E05D 7/04
(52) U.S. Cl. ..... 16/243; 16/248; 16/235
(58) Field of Search ..... 16/243, 235, 248, 16/242

(56) References Cited

U.S. PATENT DOCUMENTS 604,713 A * 5/1898 Benson
934,589 A * 9/1909 Bradford ..... 81/145
959,001 A * 5/1910 Tritsch
2,700,789 A * 2/1955 Cornwell
3,938,219 A * 2/1976 Rock et al.
3,952,366 A * 4/1976 Rock et al. ..... 16/235
4,091,499 A * 5/1978 Lautenschlager
4,430,771 A * 2/1984 Salice ..... 16/235
4,554,706 A * 11/1985 Rock et al. ..... 16/237
4,768,259 A * 9/1988 Rock et al. ..... 16/382
4,817,237 A * 4/1989 Murphy ..... 16/29
4,982,476 A * 1/1991 Salice ..... 16/382
5,056,189 A * 10/1991 Brustle et al. ..... 16/235
5,343,595 A * 9/1994 Lautenschlager ..... 16/257
5,603,142 A * 2/1997 Dubach et al. ..... 16/247
6,145,164 A * 11/2000 Ferrari et al. ..... 16/242

* cited by examiner

*Primary Examiner*—Anthony Knight
*Assistant Examiner*—Alison K. Pickard
(74) *Attorney, Agent, or Firm*—Diller, Ramik & Wight

(57) ABSTRACT

In a hinge (1) comprising a frame-side hinge portion (4) adapted to be pre-mounted to a frame (2) and a wing-side hinge portion (6) adapted to be pre-mounted to a door wing (3), wherein the hinge portions (4,6) are articulated to each other and at least one of the hinge portions (4;6) is provided with a height adjustment device (8) comprising attachment holes (10) of oval shapes extending in the adjustment direction, with attachment bolts (14) guided through the attachment holes (10), it is provided that the height adjustment device (8) comprises a releasable locking device (20) which, when in its locking position, holds the hinge portion (4;6) in a central position relative to the screwed attachment bolts (14).

24 Claims, 3 Drawing Sheets

HINGE, AND METHOD FOR HEIGHT ADJUSTMENT OF A HINGE

BACKROUND OF THE INVENTION

The present invention relates to a hinge, and method for height adjustment of a hinge.

After attachment of hinges to pieces of furniture, it is often required to read-just the height of the doors so as to compensate for manufacturing and mounting tolerances of the furniture which are caused, inter alia, by incorrect alignment of the doors. Thus, a height adjustment at the hinges is performed so as to position the doors at a uniform height.

As of yet, height adjustment of the hinges has been effected in various manners. The frame-side hinge portion attached to the frame of a piece of furniture is normally mounted to the frame by use of two threaded bolts. These bolts are guided in the frame portion via longitudinal holes extending in the direction of the height adjustment, with the length of the longitudinal holes corresponding to the desired measure of the height adjustment from a central position. In an example of a known arrangement, the longitudinal holes have holding webs located therein for holding the attachment bolts in their central positions within the longitudinal hole. If a height adjustment becomes necessary, these webs will be broken off. In this regard, it is disadvantageous that the mounting bolts have to be screwed outwards to a relatively far extent until the webs, arranged below the respective bolts, will break. Further, it is of disadvantage that these broken webs tend to fall down, thus becoming caught in other components in the cabinet or the like piece of furniture, or impeding the function of such components.

It is an object of the instant invention to provide a hinge, including a height adjustment device, which is easily handled and which does not require that parts are broken out when unlocking the hinge from its central position.

SUMMARY OF THE INVENTION

In the hinge according to the instant invention, it is advantageously provided that the height adjustment device comprises a releasable locking device which in its locking position will hold the hinge portion in a central position relative to the screwed attachment bolts. After unlocking the locking device, the hinge portion can be displaced upwards or downwards from its central position and then be fixed in place by tightening the attachment bolts.

Preferably, it is provided that the locking device is releasable by deformation of a locking projection. The locking projection is arranged to engage a recess adapted to the locking projection for thus locking the hinge portion in its central position.

It can be provided that the above deformation of the locking projection will be permanent so that the described unlocking of the hinge portion will be irreversible. By way of alternative, the locking projection can be resiliently deformable so that the hinge portion can be locked in its central position also after having been unlocked.

The locking device can be designed to be unlocked by application of a tool. Unlocking is preferably performed by use of a screw-driver which is also required for loosening or tightening the attachment bolts.

The height adjustment device comprises an adjusting element which, when operated by means of the tool, allows for height adjustment of the hinge portion.

It is particularly preferred that the tool, by engaging the adjusting element for height adjustment, will simultaneously unlock the locking device. Thus, in one working step, the hinge portion is released from the central position while at the same time, e.g. by turning the tool, the height adjustment can be performed through the engagement of the tool with the adjusting element.

The height adjustment device can comprise a stationary adjusting element having the locking projection of the locking device extending therefrom, the locking projection of the locking device engaging the hinge portion which is displaceable relative to the adjusting element. Alternatively, the locking projection of the locking device can be engaged by a locking projection extending from the hinge portion.

The adjusting element is formed with guide openings for the attachment bolts and is configured for linear guidance of the hinge portion. The attachment bolts are screwed into the frame via these guide openings so that the adjusting element will be fixed in position on the frame.

The guide openings of the adjusting element can be provided with collars projecting in the direction of the hinge portion and engaging the oval attachment holes of the hinge portions. The attachment holes are formed as longitudinal holes in the adjustment direction.

The adjusting element preferably comprises a plate-shaped member arranged between the frame or the wing of the respective door and the hinge portion. This allows for a flat configuration of the hinge portion so that the hinge portion will protrude by only a small height when attached. In a particularly preferred embodiment, the adjusting element comprises a thin punched member of sheet metal.

The adjusting element comprises a recess adapted to the tool and provided for engagement by the tool, with the hinge portion being displaceable relative to the adjusting element by rotating the tool. The tool is rotatably guided by means of a guide opening formed in the hinge portion. The tool, when engaging the recess of the adjusting element, will at the same time release the locking projection of the locking device on the adjusting element from the engagement with the recess assigned to the locking projection.

In a preferred embodiment of the invention, it is provided that the recess of the adjusting element adapted to the tool, one the one hand, and the deformable locking projection, on the other hand, are arranged opposite each other, and are formed by a sole punched cutout in the plate-shaped member or sheet-metal piece constituting the adjusting element. Such an adjusting element can be produced at low cost and allows for a high force transmission during height adjustment.

Further preferred embodiments of the hinge are mentioned in the further sub-claims.

The instant invention further provides a method for height adjustment of the wing of a door pivoted to a frame by means of a plurality of hinges attached to the frame and the door wing by means of attachment bolts, wherein, in a first step, all of the attachment bolts of the frame-side or wing-side hinge portions provided with height adjustment devices are loosened by application of a tool, that, in a second step, a locked state of the hinge portion in the central position which has been established by the height adjustment device, is released in all of the hinges, which is preferably performed using the same tool, and, at the same time, a height adjustment is performed at the last hinge, wherein the tool engages an adjusting element of the height adjustment device of the hinge portion, unlocks the hinge from its central position, and by a rotational movement brings the door wing into the desired position and holds it therein, and that, in a third step, the attachment bolts of the hinge portion are tightened again.

The inventive method offers the advantage that, even after the release of the locked state of the individual hinges, the door will always be kept in position. Also after the last hinge has been unlocked, the door cannot fall down since the tool is arranged in engagement between the adjusting element and the hinge portion, thus preventing an uncontrolled dropping of the door. As a matter of course, the operating person can slightly lift the door to avoid an excess stress acting on the tool in the final hinge. By use of a tool, preferably a cross-slotted screw driver, the height adjustment can be performed with a high degree of accuracy. When the correct position of the door wing has been reached, the attachments bolts are tightened. It is particularly advantageous that the need to break out small pieces of the hinge portion is obviated; thus, no fragments of the hinge portion can drop into the hinge or other parts of the piece of furniture and have to be removed, which would cause additional work.

The hinge portion can be provided with marking lines so that the amount of the height adjustment can be read and correctly set.

Preferred embodiments of the invention will be explained in greater detail hereunder with reference to the accompanying drawings.

DETAILED DESCRIPTION OF PREFERRED EMBODIMENTS

Figure 1:
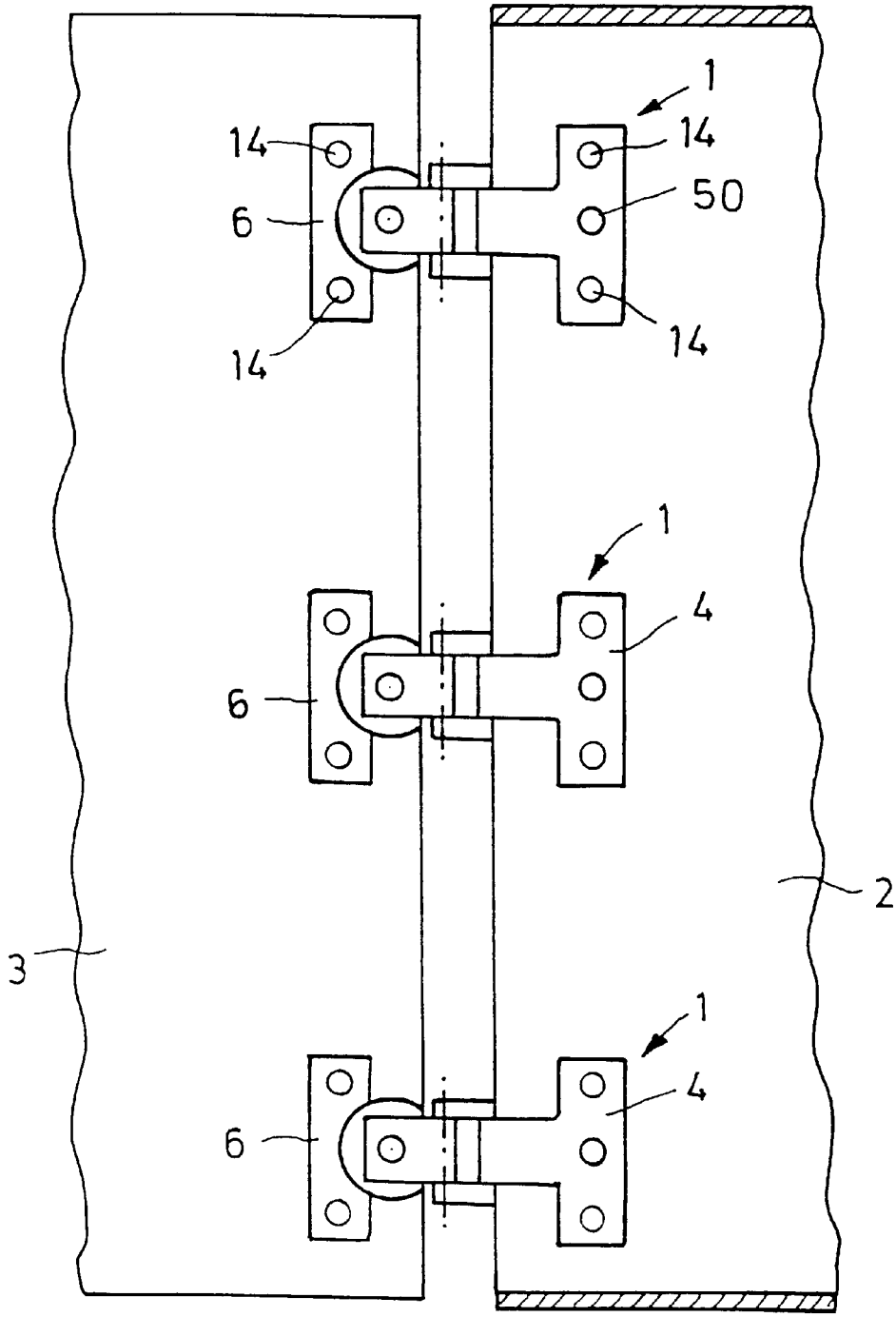
FIG. 1 is a view of the wing of a door pivoted to a frame by a plurality of hinges adjustable in height.
Figure 2:
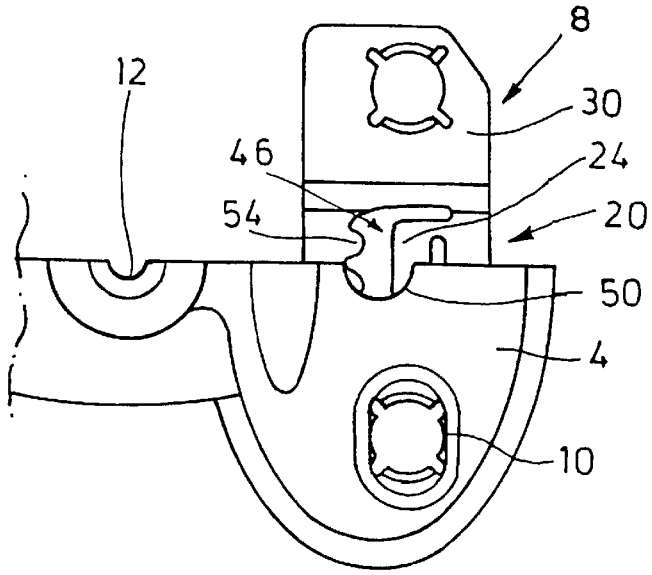
FIG. 2 is a view of a first embodiment of a hinge portion on the frame side.

FIG. 1 illustrates a door wing 3 pivoted to the frame 2 of a piece of furniture by at total of three hinges 1 which are adjustable in height. The hinges 1 have been pre-mounted to the door wing 3 and the frame 2 by attachment bolts 14. The hinges 1 comprise a frame-side hinge portion 4 pre-mounted to the frame 2, and a wing-side hinge portion 6 pre-mounted to the door wing 3. The hinge portions 4 and 6 are connected to each other in an articulated and releasable manner, and at least one of the hinge portions 4,6 is provided with a height adjustment device 8. The hinge portion 4 shown in FIG. 2 is provided, for vertical adjustment, with attachment holes 10 formed as longitudinal holes extending in the direction of adjustment and having the attachment bolts 14 guided therethrough. Of course, only one of the hinge portions 4,6 need be provided with a height adjustment device 8.

FIG. 2 illustrates a first embodiment of a frame-side hinge portion 4 with integrated height adjustment device 8. The height adjustment device 8 comprises a releasable locking device 20 with a locking projection 24. The locking projection 24 engages a recess 28, arranged on the frame-side hinge portion 4 and adapted to the locking projection 24, and thus keeps the hinge portion 4 locked in a central position relative to the attachment bolts 14 screwed through the attachment holes 10. In the embodiment according to FIG. 2, locking projection 24 is bent in the direction of the frame-side hinge portion 4 and engages a recess—shown in FIG. 3—on the underside of the frame-side hinge portion 4. Using a tool, e.g. a cross-slotted screw driver, which is inserted through a guide opening 50 of the hinge portion, the locking projection 24 can be released from its engagement with recess 28. As a result, the frame-side hinge portion 4 can be vertically displaced relative to the fixedly mounted adjusting element 30 of height adjustment device 8 from its central position by about ±2 to ±3 mm. Locking projection 24 is preferably provided for permanent deformation so that the height adjustment device 8 will remain durably unlocked upon insertion of the tool 34.

Figure 3:
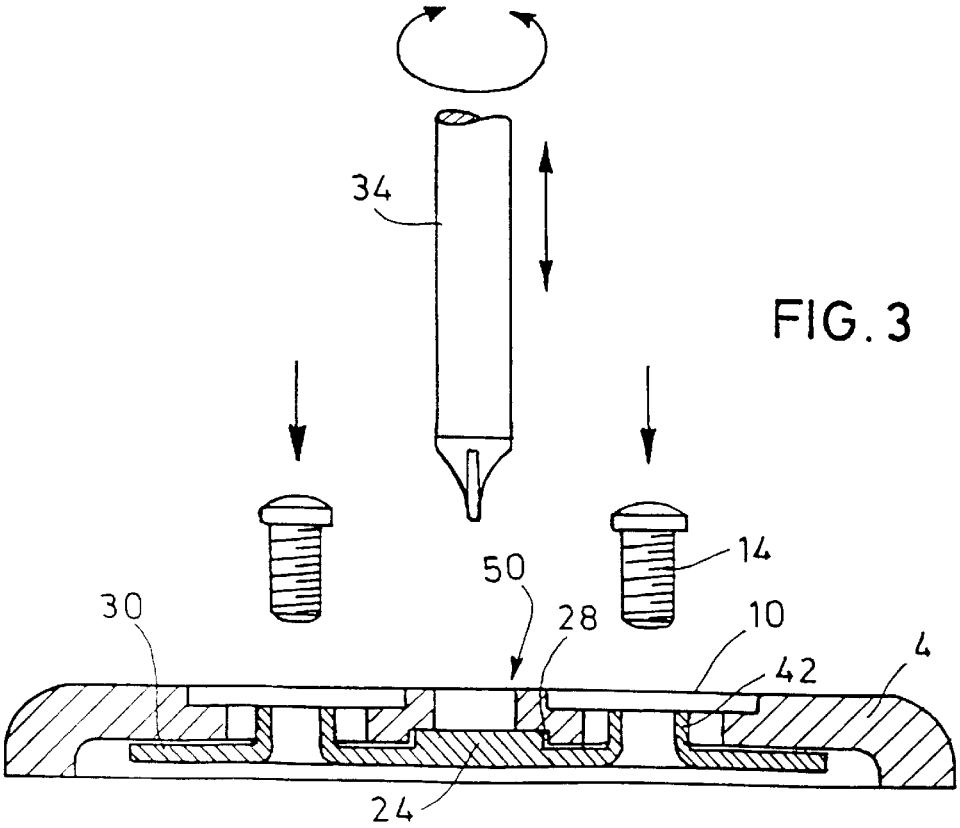
FIG. 3 is a longitudinal sectional view of a frame-side hinge portion.

FIG. 3 is a sectional view of a hinge portion 4 and the adjusting element 30 and is particularly illustrative of the manner the locking projection 24 is locked into the recess 28 of the frame-side hinge portion 4. By inserting the tool 34 through the guide opening 50, the protruding locking projection 24 can be pressed down, thus unlocking the frame-side hinge portion 4. In this condition, with the attachment bolts 14 slightly loosened, the frame-side hinge portion 4 can be moved up and down. The tool 34, which in the instant case is preferably a cross-slotted screw driver, will during its insertion into guide opening 50 not only release the locking connection 24,28 but simultaneously also engage a recess 46 of adjusting element 30 adapted to tool 34. Recess 46 is formed with a toothing 54 cooperating with the cross-slot of tool 34 to allow for height adjustment. Notably, when rotating the tool 34, the frame-side hinge portion 4 can be positioned very exactly.

When reaching the desired setting position, the attachment bolts 14 are tightened, thus exactly positioning the frame-side hinge portion 4 on frame 2. Further, an additional attachment bolt can be screwed into an attachment hole 12 for permanent fixation of the position of the frame-side hinge portion 4.

Figure 4:
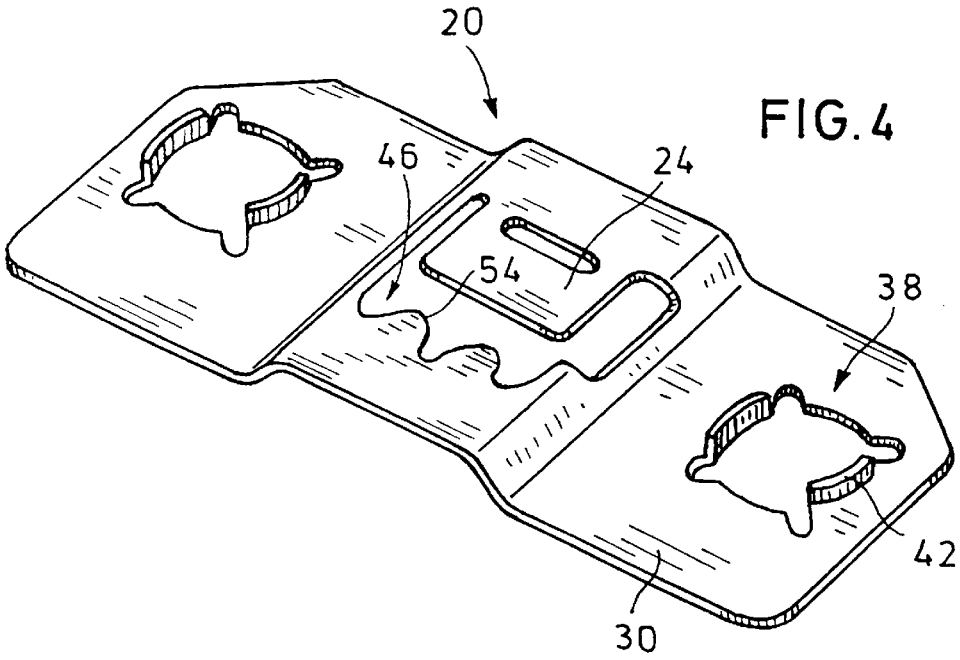
FIG. 4 is a perspective view of the adjusting element according to FIG. 2.

FIG. 4 is a perspective view of the adjusting element 30 with the reliable locking device 20. The plate-shaped adjusting element 30 preferably comprises a thin sheet-metal member but can alternatively comprise plastic. The locking projection 24 projects in upward direction relative to the other components. The embodiment of adjusting element 30 corresponds to the arrangement shown in FIG. 2. Adjusting element 30 is provided with two guide openings 38 formed with collars 42 protruding in the direction of hinge portion 4 and engaging the oval attachment holes 10 of hinge member 4. Alternatively, adjusting element 30 can be provided with guide openings 38 without protruding collars 42, or—as shown in FIG. 3, be provided with collars 42 continuously surrounding the guide openings 38.

Figure 5:
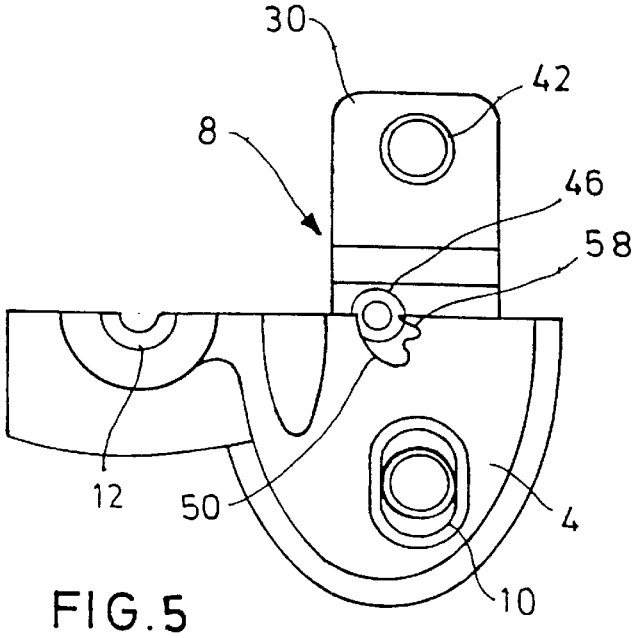
FIG. 5 is a view of a second embodiment of a hinge portion on the frame side.

FIG. 5 illustrates a second embodiment of a frame-side hinge portion 4 which is different from the embodiment according to FIG. 2 in that the guide opening 50 of hinge portion 4 is formed with a toothing 58 adapted to the contour of tool 34, and that the recess 46 of adjusting element 30 adapted to tool 34 is of a circular shape. The tool 34 engaging the recess 46 via guide opening 50 presses the adjusting element 30 downwards wherein, in the process, a collar 48 forming a locking projection 24 is pressed down on the recess 46 and is released from its engagement with the recess 28 on the frame-side hinge portion 4.

Figure 6:
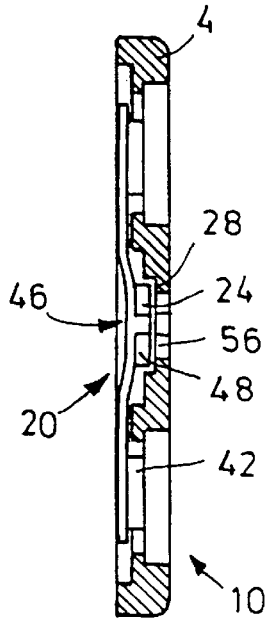
FIG. 6 is a sectional view of the hinge portion according to FIG. 5.

As a result of the above moving sequence, the frame-side hinge portion 4 is unlocked from its central position, while the tool 34 consisting of a cross-slotted screw driver, due to its engagement with the toothing 58 is effective to bring the frame-side hinge portion 4 into the desired position by rotational movement. In the embodiment according to FIGS. 5 and 6, the adjusting element 30 can comprise e.g. plastic.

For height adjustment of the door wing 3, it is provided that, in a first step, all of the attachment bolts 14 of the frame-side hinge portions 4 provided with a height adjustment device 8 are loosened by application of tool 34. Initially, during this step, all hinge portions 4 are still held in their central position relative to the screwed attachment bolts 14 by means of the releasable locking device 20. In a second step, which is preferably performed using the same tool 34, the locked state of the hinge portions 4 established by the height adjustment device 8 is released, while the door wing 3 is still held by the last not yet unlocked hinge 1. As a matter of course, it may be helpful to relieve the hinge 1 from the pressure acting on it by slightly lifting the wing 3 of the door. When unlocking the last hinge, the height adjustment can be performed at the same time by having the tool engage the adjusting element 30 of height adjustment device 8. By rotating the tool, the door wing 3 can be moved into the desired position and be held therein, and in a third step the attachment bolts 14 of the hinge portion 4 are tightened again. Thus, the door wing 3 is locked in the desired position.

It is understood that the toothings 54,58 of the frame-side hinge portion 4 and the adjusting element 30, respectively, are designed to conform with a special tool which preferably is suited also for the attachment bolts 14.

The above description has been rendered, merely by way of example, in connection with the frame-side hinge portion 4 but of course applies to the wingside hinge portion 6 as well.

What is claimed is:

1. A hinge comprising a frame-side hinge portion adapted to be mounted to a frame and a wing-side hinge portion adapted to be mounted to a door wing, means for articulately connecting said frame-side hinge portion and said wing-side hinge portion to each other, at least one of said frame-side hinge portion and wing-side hinge portion including a recess and elongated attachment holes extending in a direction of desired adjustment, attachment fasteners extending through said attachment holes, a height adjustment device associated with said at least one hinge portion, said height adjustment device including a locking member which in a locked position thereof with said attachment fasteners fastens said at least one hinge portion in a central position of adjustment, and said locking member being a locking projection formed by substantially permanently deformable material which is normally seated within said recess to prevent height adjustment until deformed to unseat relative to said recess to effect selected height adjustment of said at least one hinge portion.

2. The hinge as defined in claim 1 including means cooperable with a tool for releasing said locking projection from said recess.

3. The hinge as defined in claim 1 wherein said height adjustment device includes guide means projecting into said elongated attachment holes to guide adjusting movement of said at least one hinge portion.

4. The hinge as defined in claim 1 wherein said height adjustment device includes guide collars projecting into said elongated attachment holes to guide adjusting movement of said at least one hinge portion.

5. The hinge as defined in claim 1 wherein said height adjustment device is a plate member having opposite end portions and an offset medial portion therebetween.

6. The hinge as defined in claim 1 wherein said height adjustment device is a plate member having opposite end portions and an offset medial portion therebetween, and said offset medial portion defines said locking projection.

7. The hinge as defined in claim 1 wherein said height adjustment device is a thin punched sheet material member.

8. The hinge as defined in claim 1 wherein said height adjustment device includes means responsive to tool manipulation for substantially simultaneously releasing said locking projection from said recess and effecting adjusting movement of said at least one hinge portion.

9. The hinge as defined in claim 1 wherein said height adjustment device includes means responsive to tool manipulation for substantially simultaneously releasing said locking projection from said recess and effecting adjusting movement of said at least one hinge portion, and said tool responsive means includes toothing disposed adjacent said locking projection.

10. The hinge as defined in claim 1 wherein said height adjustment device includes means responsive to tool manipulation for substantially simultaneously releasing said locking projection from said recess and effecting adjusting movement of said at least one hinge portion, and said tool responsive means includes toothing disposed adjacent and in opposing relationship to said locking projection.

11. The hinge as defined in claim 1 wherein said height adjustment device includes means responsive to tool manipulation for substantially simultaneously releasing said locking projection from said recess and effecting adjusting movement of said at least one hinge portion, and said tool responsive means includes toothing disposed adjacent and in opposing substantially coplanar relationship to said locking projection.

12. The hinge as defined in claim 1 wherein said locking projection is a cantilevered tongue.

13. The hinge as defined in claim 1 including a tool receptive hole in said at least one hinge portion in substantially registry with said locking projection.

14. A hinge comprising a frame-side hinge portion adapted to be mounted to a frame and a wing-side hinge portion adapted to be mounted to a door wing, means for articulately connecting said frame-side hinge portion and said wing-side hinge portion to each other, at least one of said frame-side hinge portion and wing-side hinge portion including a recess and elongated attachment holes extending in a direction of desired adjustment, attachment fasteners extending through said attachment holes, a height adjustment device associated with said at least one hinge portion, said height adjustment device including a locking member which in a locked position thereof with said attachment fasteners fastens said at least one hinge portion in a central position of adjustment, and said locking member being a locking projection formed by substantially resilient material which is normally seated within said recess to prevent height adjustment until resiliently unseated relative to said recess to effect selected height adjustment of said at least one hinge portion.

15. The hinge as defined in claim 14 including means cooperable with a tool for releasing said locking projection from said recess.

16. The hinge as defined in claim 14 wherein said height adjustment device includes guide means projecting into said elongated attachment holes to guide adjusting movement of said at least one hinge portion.

17. The hinge as defined in claim 14 wherein said height adjustment device includes guide collars projecting into said elongated attachment holes to guide adjusting movement of said at least one hinge portion.

18. The hinge as defined in claim 14 wherein said height adjustment device is a plate member having opposite end portions and an offset medial portion therebetween.

19. The hinge as defined in claim 14 wherein said height adjustment device is a plate member having opposite end portions and an offset medial portion therebetween, and said offset medial portion defines said locking projection.

20. The hinge as defined in claim 14 wherein said height adjustment device is a thin punched sheet material member.

21. The hinge as defined in claim 14 wherein said height adjustment device includes means responsive to tool manipulation for substantially simultaneously releasing said locking projection from said recess and effecting adjusting movement of said at least one hinge portion.

22. The hinge as defined in claim 14 wherein said height adjustment device includes means responsive to tool manipulation for substantially simultaneously releasing said locking projection from said recess and effecting adjusting movement of said at least one hinge portion, and said tool responsive means includes toothing disposed adjacent said locking projection.

23. The hinge as defined in claim 22 wherein said toothing is a tool receptive hole in said at least one hinge portion in substantially registry with said locking projection.

24. The hinge as defined in claim 14 wherein said height adjustment device includes means responsive to tool manipulation for substantially simultaneously releasing said locking projection from said recess and effecting adjusting movement of said at least one hinge portion, and said tool responsive means includes toothing disposed adjacent and in axially spaced relationship to said locking projection.

* * * * *